US009532702B2

(12) United States Patent
Wegener et al.

(10) Patent No.: US 9,532,702 B2
(45) Date of Patent: Jan. 3, 2017

(54) CUTLERY DRAWER FOR A DISHWASHER

(71) Applicant: Miele & Cie. KG, Guetersloh (DE)

(72) Inventors: Dirk Wegener, Bielefeld (DE); Cornelius Wolf, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 339 days.

(21) Appl. No.: 14/146,833

(22) Filed: Jan. 3, 2014

(65) Prior Publication Data

US 2014/0190528 A1 Jul. 10, 2014

(30) Foreign Application Priority Data

Jan. 9, 2013 (DE) ..... 10 2013 100 138

(51) Int. Cl.
*A47L 15/50* (2006.01)

(52) U.S. Cl.
CPC ..... *A47L 15/502* (2013.01); *A47L 15/503* (2013.01); *A47L 15/504* (2013.01)

(58) Field of Classification Search
CPC .... A47L 15/502; A47L 15/503; A47L 15/504; A47L 15/505
See application file for complete search history.

(56) References Cited

U.S. PATENT DOCUMENTS

| | | | | |
|---|---|---|---|---|
| 2008/0072937 | A1 | 3/2008 | Choi et al. | |
| 2008/0156362 | A1 | 7/2008 | Shin et al. | |
| 2010/0078048 | A1 | 4/2010 | Schessl et al. | |
| 2010/0155280 | A1 | 6/2010 | Graute et al. | |
| 2012/0139400 | A1* | 6/2012 | Hofpeter | A47L 15/505 312/228.1 |
| 2013/0002107 | A1 | 1/2013 | Paschini et al. | |

FOREIGN PATENT DOCUMENTS

| | | | |
|---|---|---|---|
| DE | 102006055352 | A1 | 5/2008 |
| DE | 102008062761 | B3 | 3/2010 |
| DE | 102010042409 | A1 | 4/2012 |
| EP | 2364636 | A1 | 9/2011 |
| EP | 2594186 | A1 | 5/2013 |

* cited by examiner

*Primary Examiner* — Jason Ko
*Assistant Examiner* — Spencer Bell
(74) *Attorney, Agent, or Firm* — Leydig, Voit & Mayer, Ltd.

(57) ABSTRACT

A cutlery drawer for a dishwasher includes a frame extendably supported within a washing tub and a plurality of inserts which are movably disposed on the frame and are configured to hold dishware items to be washed. The plurality of inserts include a horizontally displaceable disposed on the frame so as to be horizontally displaceable in a direction perpendicular to a direction of withdrawal of the cutlery drawer and a vertically displaceable insert disposed on the frame so as to be vertically displaceable. The horizontally displaceable insert has longitudinal sides extending in the direction of withdrawal of the cutlery drawer and is disposed on the frame so as to be vertically displaceable at one of the longitudinal sides.

18 Claims, 7 Drawing Sheets

CUTLERY DRAWER FOR A DISHWASHER

CROSS REFERENCE TO RELATED APPLICATIONS

This application claims priority from German Patent Application No. DE 10 2013 100 138.6, filed Jan. 9, 2013, which is hereby incorporated by reference herein in its entirety.

FIELD

The present invention relates to a cutlery drawer for a dishwasher, including a frame extendably supported within a washing tub and a plurality of inserts which are movably disposed on the frame and on which may be placed dishware items to be washed, especially cutlery, at least one of the inserts being disposed on the frame in such a way that it is horizontally displaceable in a direction perpendicular to the direction of withdrawal of the cutlery drawer, and at least one other of the inserts being disposed on the frame in such a way that it is vertically displaceable.

BACKGROUND

Dishwashers and cutlery drawers for dishwashers are per se are well known in the art. A cutlery drawer of the aforementioned type for a dishwasher is disclosed in DE 10 2008 062 761 B3.

Dishwashers have a washing tub providing a washing chamber which, during normal use, serves to receive items to be washed such as, for example, dishes, cutlery and/or the like. Typically, dish drawers are provided for receiving the dishware. Such dish drawers are also referred to as dish racks and capable of being slid out of the washing chamber provided by the washing tub. Generally, two such dish racks are disposed one above the other in the washing chamber and accordingly used as an upper rack and a lower rack, respectively.

For purposes of holding cutlery items, cutlery drawers have become known which can be slid out of the washing chamber provided by the washing tub, just as the dish drawers. Such cutlery drawers have an insert for holding cutlery. The insert in turn has supporting webs for separate placement of individual items of cutlery.

A cutlery drawer is typically disposed uppermost; i.e., above an upper rack in the washing tub of the dishwasher. To be able to place also larger dishware items in the upper rack located immediately below the cutlery drawer, the cutlery drawer described in DE 10 2008 026 761 B3 was developed, which has a frame having inserts movably disposed thereon. At least one of the inserts is horizontally displaceably disposed on the frame and at least one other of the inserts is vertically displaceably disposed on the frame. This design allows the horizontally displaceable insert of the cutlery drawer to be moved to a position of non-use, which provides additional height for the dish rack located therebelow so as to allow, for example, larger dishware items to be placed in this dish rack.

The cutlery drawer described in DE 10 2008 026 761 B3 has proven practical in everyday use. Nevertheless, efforts are being made to further optimize the space utilization of the washing chamber.

SUMMARY

In an embodiment, the present invention provides a cutlery drawer for a dishwasher including a frame extendably supported within a washing tub and a plurality of inserts which are movably disposed on the frame and are configured to hold dishware items to be washed. The plurality of inserts include a horizontally displaceable disposed on the frame so as to be horizontally displaceable in a direction perpendicular to a direction of withdrawal of the cutlery drawer and a vertically displaceable insert disposed on the frame so as to be vertically displaceable. The horizontally displaceable insert has longitudinal sides extending in the direction of withdrawal of the cutlery drawer and is disposed on the frame so as to be vertically displaceable at one of the longitudinal sides.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
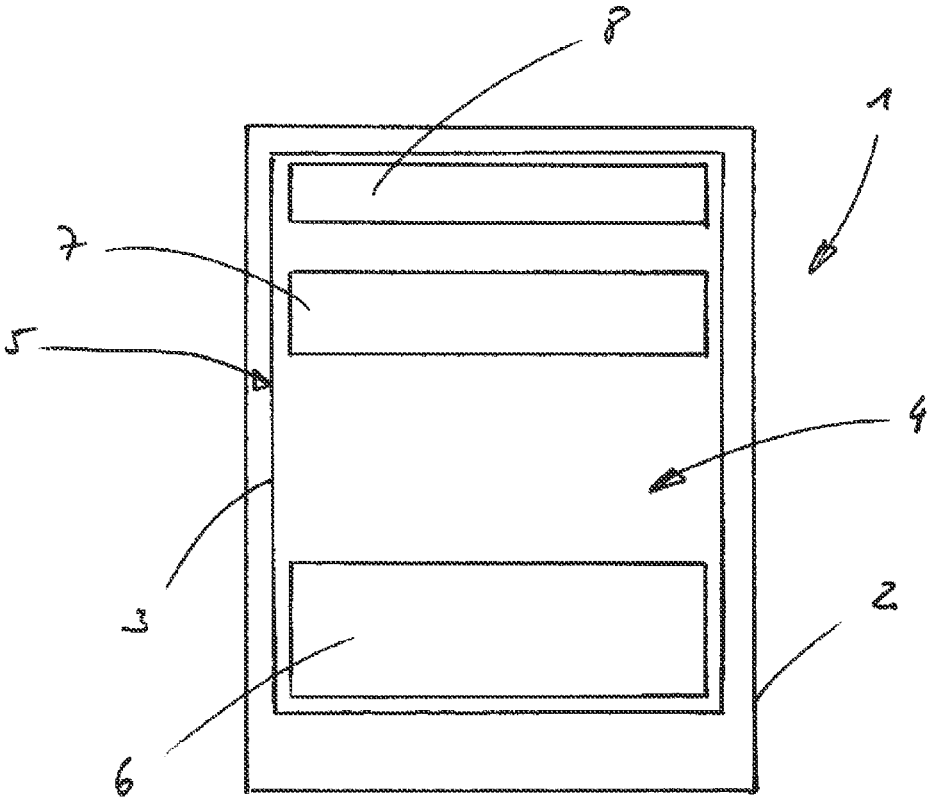
FIG. 1 is a purely schematic front view of a dishwasher.

An aspect of the present invention is to provide a cutlery drawer that is further improved in terms of space utilization.

In an embodiment, the present invention provides a cutlery drawer of the type mentioned at the outset where the horizontally displaceable insert is disposed on the frame in such a way that it is vertically displaceable at one of its longitudinal sides extending in the direction of withdrawal of the cutlery drawer.

The cutlery drawer according to the present invention has at least one insert which is disposed on the frame in such a way that it is both horizontally displaceable, in particular in a direction perpendicular to the direction of withdrawal of the cutlery drawer from the dishwasher, and also vertically displaceable at one side, namely one of its two longitudinal sides extending in the direction of withdrawal of the cutlery drawer. This design makes it possible, on the one hand, to displace the insert in a generally known manner horizontally in a direction perpendicular to the direction of withdrawal of the cutlery drawer and, on the other hand, to incline it with respect to the horizontal by lowering it at one side. In this way, the space provided by the cutlery drawer for receiving items to be washed can be enlarged downwardly in the vertical direction, so that larger items of cutlery or dishwasher can also be received by the cutlery drawer. Thus, the space utilization of the washing chamber is advantageously optimized because items to be washed which heretofore could only be placed in the upper rack and/or lower rack can now also be placed in the cutlery drawer. This advantageously increases the user's options as to the placement of items to be washed in the washing chamber, which in turn allows for optimized space utilization.

In accordance with a further aspect of the present invention, the frame holding the inserts has a frame wire at each of the front and rear sides, which frame wire has a guide track for the horizontally displaceable insert, the path of the guide track having a vertical component at least in a portion thereof Preferably, the guide track is formed by a frame wire portion sloping in a plane extending vertically to the direction of withdrawal (X) of the cutlery drawer. In other words, the frame holding the inserts has a frame wire at each of the front and rear sides, which frame wire at least partially slopes in a plane extending vertically to the direction of withdrawal of the cutlery drawer. This frame wire firstly serves to support the horizontally displaceable insert, and secondly provides a guide track. The guide track is at least partially configured to have a vertical component, in particular to slope with respect to the vertical, when the cutlery drawer is received in its normal position in the dishwasher. This makes it possible firstly to displace the insert horizontally, and secondly to displace it vertically at one of its two longitudinal sides extending in the direction of withdrawal of the cutlery drawer. This guide track, which is defined by the contour of the frame wire, provides an additional plane for the horizontally displaceable insert, so that the insert can not only be displaced horizontally, but also lowered laterally.

Preferably, the vertically extending guide track is formed by a frame wire portion sloping in a plane extending vertically to the direction of withdrawal of the cutlery drawer. This shape is relatively easy to manufacture because it can be created simply by bending the frame wire over.

When the longitudinal side of the horizontally displaceable insert is in the vertically lowered position, the insert forms an angle of inclination of from 15° to 20° with the horizontal. With such an angle of inclination, sufficient space remains for an upper rack located immediately below the cutlery drawer to receive the items to be washed that are typically placed in an upper rack, such as, for example, wine glasses. In addition, an angle of inclination of the aforementioned magnitude is advantageous in that it provides optimized run-off of residual moisture from the items to be washed that are received by the cutlery drawer. Thus, an angle of inclination having a magnitude of from 15° to 20° provides an optimized relationship between space requirements and the run-off behavior of residual moisture.

In accordance with a further aspect of the present invention, the longitudinal side of the horizontally displaceable insert has a handle. During normal use, this handle can be grasped by the user to optionally displace the horizontally displaceable plane to a desired position relative to the frame.

In accordance with another aspect of the present invention, the guide track of the frame wire provides a motion-limiting stop. This motion-limiting stop serves to position the horizontally displaceable insert in an inclined position and retain it in this position. This ensures that, even when in its inclined position, the insert will always assume its intended end position.

In accordance with yet another aspect of the present invention, the cutlery drawer has two horizontally displaceable inserts. In order to enable the inserts to be displaced to a sufficient extent, the width of a horizontally displaceable insert should be between 30% and 45%, preferably 40% of the width of the cutlery drawer. Thus, once a horizontally displaceable insert is displaced, even larger dishware items, such as plates, high pots, or the like, may be placed in the dish rack below the cutlery drawer.

The cutlery drawer preferably has a vertically displaceable insert disposed between the two horizontally movable inserts. When in the lowered position, the vertically displaceable insert may be used, in particular, to receive larger cutlery items such as, for example, soup dippers or ladles and/or the like, The present invention further proposes a dishwasher having a washing tub which provides a washing chamber and in which a cutlery drawer of the aforedescribed type is extendably disposed in the aforedescribed manner. A dishwasher equipped with such a cutlery drawer is optimized in terms of space utilization because the user can optionally use the cutlery drawer also to hold larger items of cutlery or dishware while maintaining the usability of the upper rack located immediately below the cutlery drawer.

Besides, the advantages described hereinbefore with reference to the cutlery drawer are also obtained for a dishwasher equipped with such a cutlery drawer.

FIG. 1 shows, in a purely schematic front view, a dishwasher 1 according to the present invention.

Dishwasher 1 has a housing 2 which accommodates a washing tub 3 providing a washing chamber 4 which, during normal use, serves to receive items to be washed.

The washing chamber 4 provided by washing tub 3 is accessible through a loading opening 5, which can be closed by a washing chamber door pivotably mounted to housing 2.

For purposes of receiving the items to be washed, two dish drawers (also referred to as dish racks) 6 and 7, as well as a cutlery drawer 8, are disposed in washing tub 3 such that they can be pulled out therefrom.

As can be seen in the view of FIG. 1, cutlery drawer 8 is disposed above dish rack 7, the so-called upper rack, with respect to the drawing plane of FIG. 1. Upper rack 7 is in turn disposed above dish rack 6, which is also referred to as lower rack. As further shown in FIG. 1, cutlery drawer 8 has about the same dimensions in terms of width as dish racks 6 and 7 located therebelow, but is flatter in the horizontal direction.

Figure 2A:
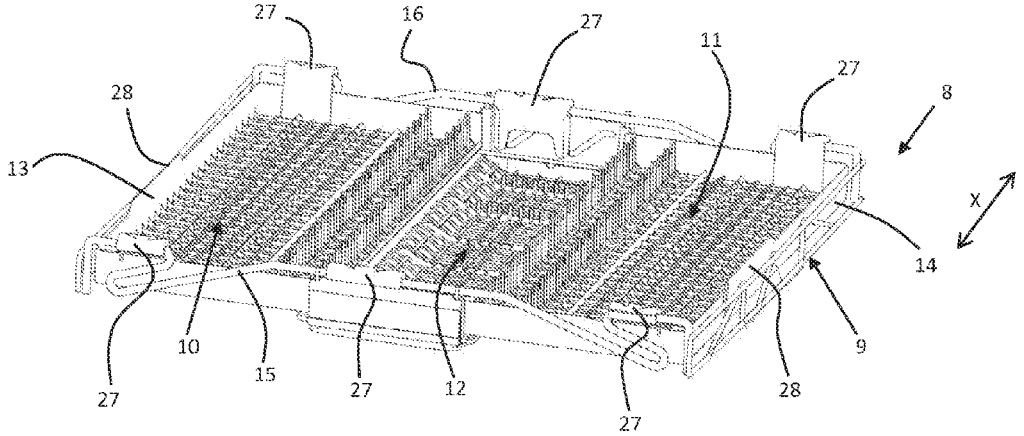
FIG. 2*a* is a schematic perspective view of a cutlery drawer according to the present invention, shown in the normal position.
Figure 2B:
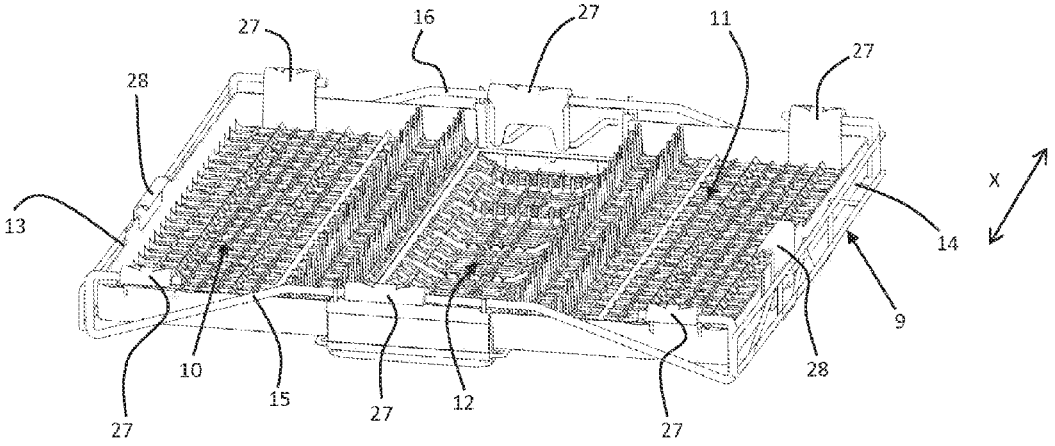
FIG. 2*b* is a schematic perspective view of an alternative embodiment of the cutlery drawer according to the present invention, shown in the normal position.

FIG. 2*a* and FIG. 2*b* show in schematic perspective views two exemplary embodiments of cutlery drawer 8 according to the present invention. The cutlery drawer has a frame 9 made of plastic-coated metal wire. Frame 9 is formed by a first frame wire 15 and a second frame wire 16, which are connected by two skeleton framework-like longitudinal braces. The longitudinal braces serve for attachment of rollers by which cutlery drawer 8 is extendably supported on lateral pull-out guides within washing tub 3. The direction of withdrawal of cutlery drawer 8 is indicated in the figures by the double arrow denoted X.

Two flat inserts 10 and 11 are provided to receive dishware items, in particular cutlery items, and are disposed on frame 9 such that they can be displaced horizontally; i.e., from left to right or in the opposite direction with respect to the drawing plane of FIG. 2. These inserts 11 and 12 are formed as mesh inserts from plastic or from plastic-coated wire.

A central insert 12 is disposed between the two lateral, horizontally displaceable inserts 10 and 11. This central insert 12, just as lateral inserts 10 and 11, is designed as a mesh insert, but has a trapezoidal depression allowing larger cutlery items to be received therein. Central insert 12 is disposed on frame wires 15 and 16 of frame 9 by two hangers 27 which allow central insert 12 to be displaced vertically; i.e., upwardly from below or in the opposite direction with respect to the drawing plane of FIG. 2.

The two lateral, horizontally displaceable inserts 10 and 11 are each also disposed on frame wires 15 and 16 by two hangers 27. This arrangement allows the respective inserts 10 and 11 to be moved along frame wires 15 and 16.

Figure 4:
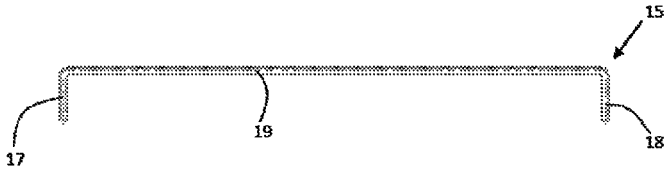
Fig. 4 (Prior Art)
FIG. 4 is a schematic view of a frame wire of a cutlery drawer according to the prior art.

FIG. 4 shows in schematic view a frame wire 15 according to the prior art, which has marginal supports 17 and 18 connecting frame wire 15 to the longitudinal braces of frame 9. Frame wire 15 further provides a horizontally oriented portion 19 connecting marginal supports 17 and 18. Accordingly, an insert held by a frame wire 15 according to the prior art can be displaced horizontally; i.e., from left to right or in the opposite direction with respect to the drawing plane of FIG. 4.

Figure 3A:
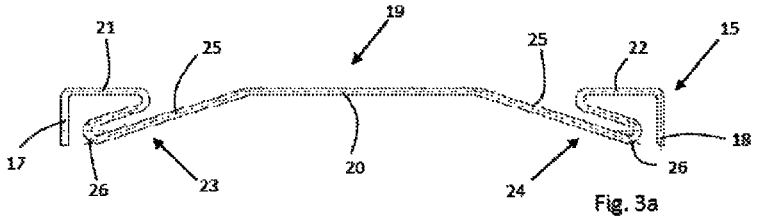
FIG. 3*a* is a schematic view showing a frame wire of a cutlery drawer according to the present invention.
Figure 3B:
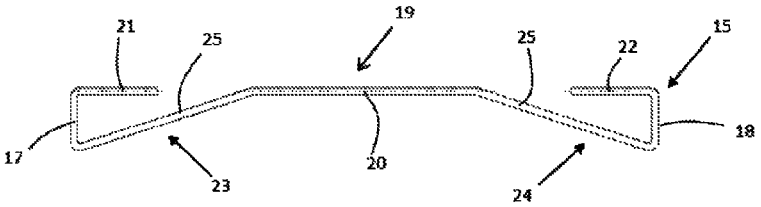
FIG. 3*b* is a schematic view of an alternatively shaped frame wire of a cutlery drawer according to the present invention.

FIGS. 3*a* and 3*b* show two exemplary embodiments of a frame wire 15 of the cutlery drawer 8 according to the present invention. In contrast to the prior art frame wire shown in FIG. 4, connecting portion 19 of this frame wire 15 is configured differently.

The connection portion 19 of the frame wire 15 according to the present invention has a horizontal central portion 20 and two horizontal marginal portions 21 and 22 adjoining marginal supports 17 and 18. A guide track 23 extends between horizontal marginal portion 21 and horizontal central portion 20. A guide track 24 is provided between horizontal marginal portion 22 and horizontal central portion 20. Guide track 23 and guide track 24 both have a sloping portion 25 which, in the exemplary embodiment of FIG. 3*a*, leads into a motion-limiting stop 26. In both embodiments, guide tracks 23 and 24 altogether constitute a loop-like configuration of frame wire 15, which connects the otherwise horizontal marginal and central portions.

In FIGS. 3*a* and 3*b*, frame wire 15 is shown by way of example. Wire frame 16 which, in the final assembled state of cutlery drawer 8, is located at the rear is configured identically, as is apparent when viewing FIGS. 2*a*, 5*a*, 6*a* and 8 (and 2*b*, 5*b*, 6*b* and 8, respectively) together.

The operating principle of cutlery drawer 8 according to the present invention will now be illustrated with reference to the insert 10 shown on the left in FIGS. 2*a*, 5*a*, 6*a* and 8 (and 2*b*, 5*b*, 6*b* and 8, respectively).

FIG. 2*a* and FIG. 2*b* show cutlery drawer 8 in its normal position. Insert 10 located on the left with respect to the drawing plane of FIG. 2*a* and FIG. 2*b* is supported via its hangers 27 on horizontal marginal portions 21 of frame wires 15 and 16. In this position, insert 10 is oriented horizontally.

Figure 5A:
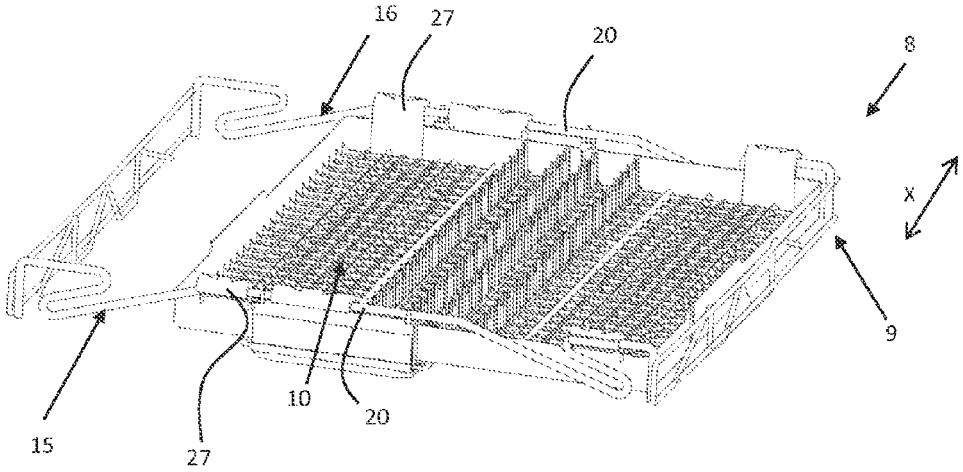
FIG. 5*a* is a schematic perspective view of a cutlery drawer according to the present invention, shown with a horizontally displaced insert.
Figure 5B:
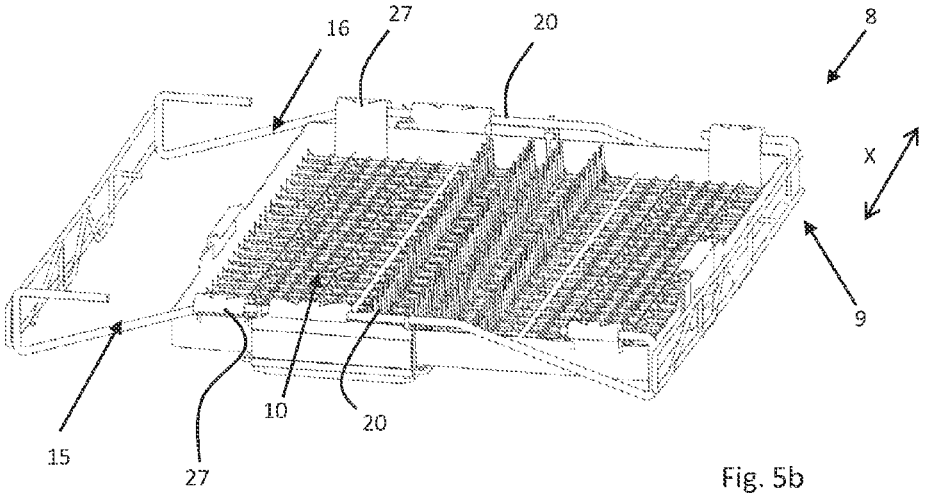
FIG. 5*b* is a schematic perspective view of an alternative embodiment of the cutlery drawer according to the present invention, shown with a horizontally displaced insert.

In FIGS. 5*a* and 5*b*, insert 10 is shown displaced to the right with respect to the drawing plane of FIGS. 5*a* and 5*b*. When in this position, as can be seen in this view, insert 10 is supported by its hangers 27 on horizontal central portion 20 of frame wires 15 and 16. In this position, too, insert 10 is oriented horizontally.

Figure 6A:
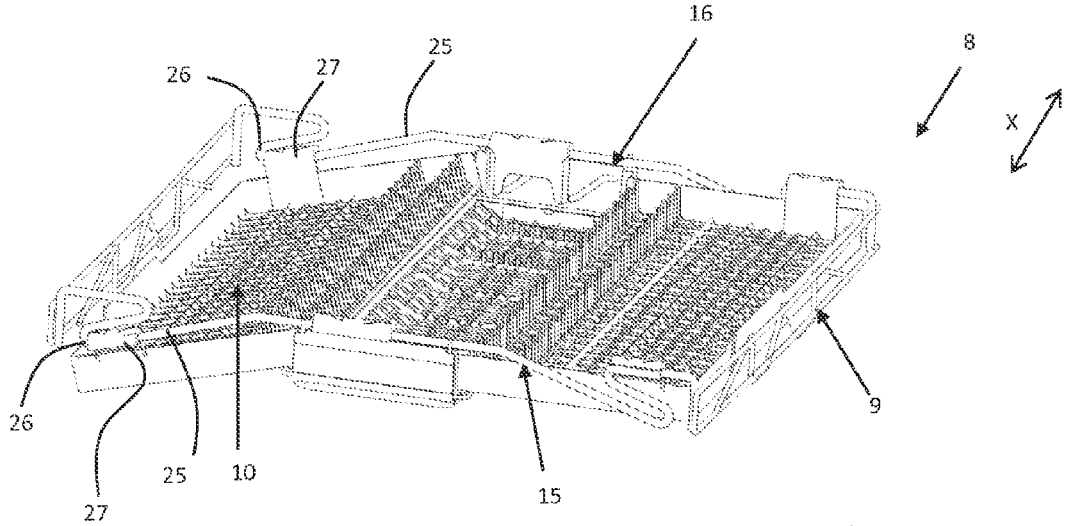
FIG. 6*a* is a schematic perspective view of a cutlery drawer according to the present invention, shown with a laterally lowered insert.
Figure 6B:
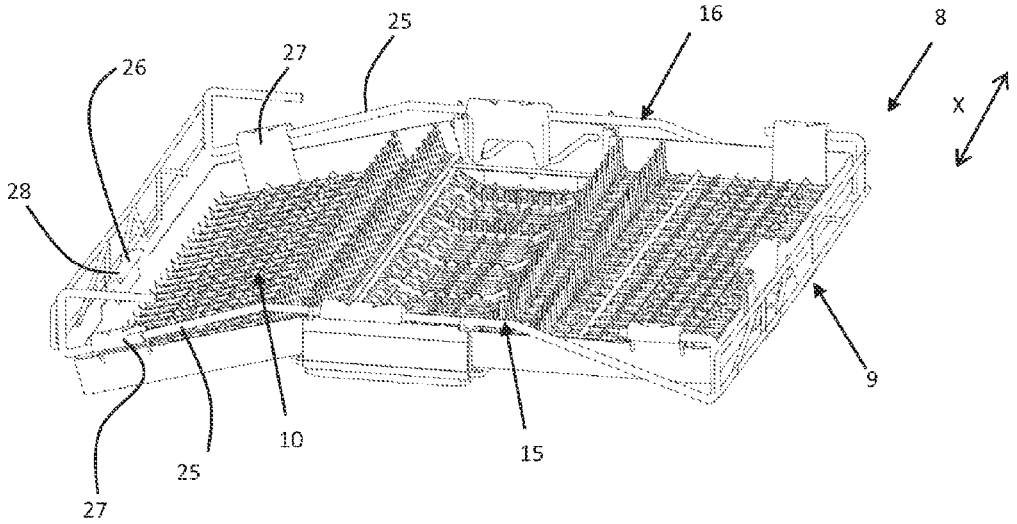
FIG. 6*b* is a schematic perspective view of an alternative embodiment of the cutlery drawer according to the present invention, shown with a laterally lowered insert.

FIG. 6*a* and FIG. 6*b* each show insert 10 in the laterally lowered position. When in this position, insert 10 is supported by sloping portions 25 of frame wires 15 and 16. In the exemplary embodiment of FIG. 6*a*, insert 10 rests with its hangers 27 against the respective stops 26 of frame wires 15 and 16, and is thereby securely held in position. In the exemplary embodiment of FIG. 6*b*, insert 10 rests with a stop member 26' disposed at longitudinal side 13 against the longitudinal braces of frame 9, which also provides a secure position for insert 10. As shown in FIG. 6*b*, stop member 26' may be configured like a handle to further improve the ease of handling.

Figure 8:
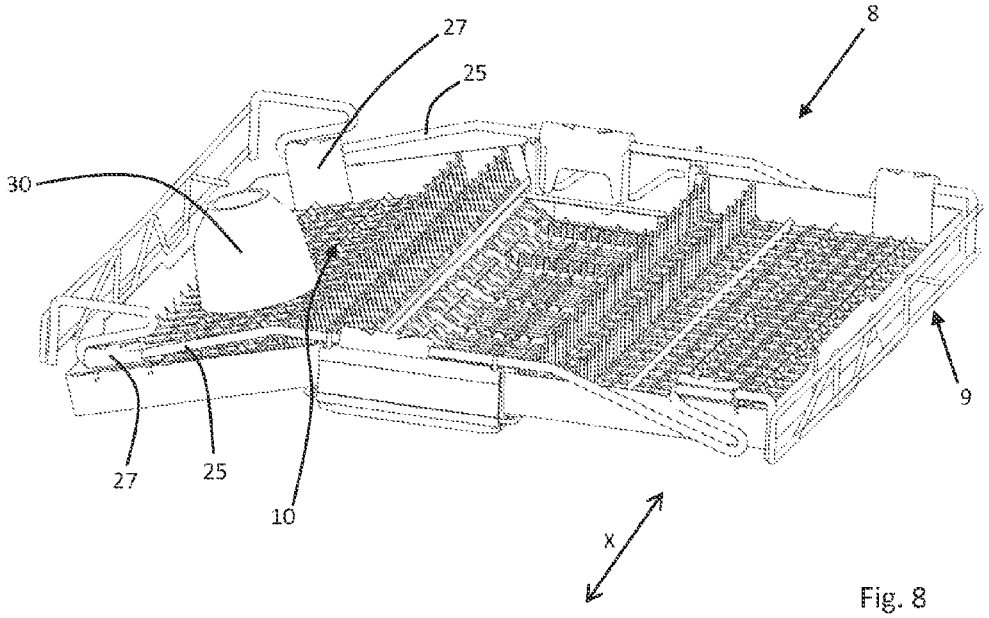
FIG. 8 is a view showing the cutlery drawer of FIG. 6*a* and a cup held by the cutlery drawer as an item to he washed.

When insert 10 is in the position shown in FIG. 6*a* and FIG. 6*b*, additional height is provided for cutlery drawer 8, so that larger dishware items can be received, such as, for example, a cup 30, as shown in FIG. 8.

Figure 7:
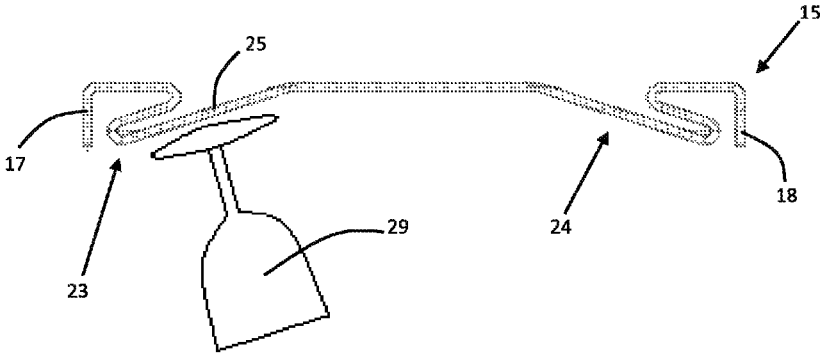
FIG. 7 is a schematic view of a frame wire of the cutlery drawer according to the present invention, shown in combination with a wine glass held by an upper rack not specifically shown.

Thanks to both the horizontal and vertical displaceability of insert 10, the insert can assume the three positions shown in FIGS. 2*a*, 5*a*, and 6*a* (and 2*b*, 5*b*, and 6*b*, respectively). The position shown in FIGS. 2*a* and 2*b* is to be selected for standard loading of dishwasher 1. The position shown in FIGS. 5*a* and 5*b* is to be selected when larger dishware items need to be placed in upper rack 7 located immediately below cutlery drawer 8 and, therefore, additional space is required above the upper rack, which can be provided by displacing insert 10 to the right side with respect to the drawing plane of FIGS. 5*a* and 5*b*. Finally, FIGS. 6*a* and 6*b* show the position of insert 10, in which more receiving space is obtained for cutlery drawer 8 itself as a result of the inclination of insert 10 with respect to the horizontal. The angle of inclination between insert 10 and the horizontal is preferably between 15° and 20°. This angle is due to the inclination of the sloping portions 25 of guide tracks 23 and 24. The angle of inclination; i.e., the profile of sloping portions 25, should be selected such that sufficient space remains for items to be washed that are placed in upper rack 7 below cutlery drawer 8, as is illustrated by a wine glass 29 in FIG. 7.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE NUMERALS

1 dishwasher
2 housing
3 washing tub
4 washing chamber
5 loading opening
6 lower rack
7 upper rack
8 cutlery drawer
9 frame
10 insert
11 insert
12 insert
13 longitudinal side
14 longitudinal side
15 frame wire
16 frame wire
17 marginal support
18 marginal support
19 connecting portion
20 horizontal central portion
21 horizontal marginal portion
22 horizontal marginal portion
23 guide track
24 guide track
25 sloping portion
26 stop
26' stop member
27 hanger
28 handle
29 glass
30 cup
X direction of withdrawal of cutlery drawer 8

What is claimed is:

1. A cutlery drawer for a dishwasher comprising:

a frame extendably supported within a washing tub, the frame including a first horizontal marginal portion and a first sloping portion;

a plurality of inserts which are movably disposed on the frame and are configured to hold dishware items to be washed, the plurality of inserts including:

a horizontally displaceable insert having longitudinal sides extending in a direction of withdrawal of the cutlery drawer, the horizontally displaceable insert being disposed on the frame so as to be horizontally displaceable in a direction perpendicular to a direction of withdrawal of the cutlery drawer and so as to be vertically displaceable along the frame downward at one of the longitudinal sides so as to dispose the horizontally displaceable insert in an inclined washing position on the frame; and a vertically displaceable insert disposed on the frame so as to be vertically displaceable, wherein a first guide track extends from the first, horizontal marginal portion to the first sloping portion, the first guide track providing for the horizontal and vertical displaceability of the horizontally displaceable insert, wherein the first horizontal marginal portion supports the horizontally displaceable insert when the horizontally displaceable insert is oriented horizontally, and wherein the first sloping portion supports the horizontally displaceable insert when in the inclined washing position.

2. The cutlery drawer as recited in claim 1, wherein the frame includes front and rear sides and has a frame wire at each of the front and rear sides, one of the frame wires including the first guide track and a second guide track.

3. The cutlery drawer as recited in claim 2, wherein at least one of the guide tracks has a motion-limiting stop.

4. The cutlery drawer as recited in claim 1, wherein the frame includes front and rear sides and has a frame wire at each of the front and rear sides, the frame wire at least partially sloping in a plane extending vertically to the direction of withdrawal of the cutlery drawer.

5. The cutlery drawer as recited in claim 1, wherein when the longitudinal side of the horizontally displaceable insert is in the inclined washing position, the insert forms an angle of inclination of from 15° to 20° with the horizontal.

6. The cutlery drawer as recited in claim 1, wherein the longitudinal side has a handle.

7. The cutlery drawer as recited in claim 1, further comprising another horizontally displaceable insert disposed on the frame.

8. The cutlery drawer as recited in claim 1, wherein the vertically displaceable insert is disposed on the frame between two horizontally displaceable inserts.

9. The cutlery drawer as recited in claim 1, wherein the horizontally displaceable insert is disposed on the frame so as to be movable over the vertically displaceable insert.

10. A dishwasher comprising:

a washing tub that provides a washing chamber; and a cutlery drawer extendably disposed in the washing tub, the cutlery drawer including a frame extendably supported within the washing tub, the frame including a first horizontal marginal portion and a first sloping portion, and the cutlery drawer including a plurality of inserts which are movably disposed on the frame and are configured to hold dishware items to be washed, the plurality of inserts including:

a horizontally displaceable insert having longitudinal sides extending in a direction of withdrawal of the cutlery drawer, the horizontally displaceable insert being disposed on the frame so as to be horizontally displaceable in a direction perpendicular to a direction of withdrawal of the cutlery drawer and so as to be vertically displaceable along the frame downward at one of the longitudinal sides so as to dispose the horizontally displaceable insert in an inclined washing position on the frame; and a vertically displaceable insert disposed on the frame so as to be vertically displaceable, wherein a first guide track extends from the first, horizontal marginal portion to the first sloping portion, the first guide track providing for the horizontal and vertical displaceability of the horizontally displaceable insert, wherein the first horizontal marginal portion supports the horizontally displaceable insert when the horizontally displaceable insert is oriented horizontally, and wherein the first sloping portion supports the horizontally displaceable insert when in the inclined washing position.

11. The dishwasher as recited in claim 10, wherein the frame includes front and rear sides and has a frame wire at each of the front and rear sides, one of the frame wires including the first guide track and a second guide track.

12. The dishwasher as recited in claim 11, wherein at least one of the guide tracks has a motion-limiting stop.

13. The dishwasher as recited in claim 10, wherein the frame includes front and rear sides and has a frame wire at each of the front and rear sides, the frame wire at least partially sloping in a plane extending vertically to the direction of withdrawal of the cutlery drawer.

14. The dishwasher as recited in claim 10, wherein when the longitudinal side of the horizontally displaceable insert is in the inclined washing position, the insert forms an angle of inclination of from 15° to 20° with the horizontal.

15. The dishwasher as recited in claim 10, wherein the longitudinal side has a handle.

16. The dishwasher as recited in claim 10, further comprising another horizontally displaceable insert disposed on the frame.

17. The dishwasher as recited in claim 10, wherein the vertically displaceable insert is disposed on the frame between two horizontally displaceable inserts.

18. The dishwasher as recited in claim 10, wherein the horizontally displaceable insert is disposed on the frame so as to he movable over the vertically displaceable insert.

* * * * *